US006029809A

United States Patent [19]

Skiba et al.

[11] Patent Number: 6,029,809

[45] Date of Patent: Feb. 29, 2000

[54] PATIENT BATHING SYSTEM AND WASHCLOTH FOR BODY CLEANSING

[75] Inventors: Barbara T. Skiba, Chicago; Steven W. Hickman, Woodstock; Keith M. Simon, Crystal Lake; Paul H. Hanifl, Barrington Hills, all of Ill.

[73] Assignee: Sage Products, Inc., Crystal Lake, Ill.

[21] Appl. No.: 09/349,893

[22] Filed: Jul. 8, 1999

Related U.S. Application Data

[62] Division of application No. 08/961,470, Oct. 31, 1997, Pat. No. 5,956,794.

[51] Int. Cl.[7] ..... B65D 81/24

[52] U.S. Cl. ..... 206/210; 206/440; 15/104.93; 15/208; 15/209.1; 15/210.1

[58] Field of Search ..... 15/104.93, 104.94, 15/208, 209.1, 210.1, 228, 229.1, 229.2; 206/205, 210, 207, 438, 440, 494

[56] References Cited

U.S. PATENT DOCUMENTS

| | | | |
|---|---|---|---|
| 3,846,158 | 11/1974 | Vasilyadis | 15/104.93 |
| 4,114,224 | 9/1978 | Disko | 15/229.1 |
| 4,313,774 | 2/1982 | Arthur | 15/229.1 |
| 4,775,582 | 10/1988 | Abba | 15/104.93 |
| 4,931,201 | 6/1990 | Julemont | 15/104.93 |
| 5,066,527 | 11/1991 | Newell | 15/229.1 |
| 5,094,770 | 3/1992 | Sheridan | 15/104.93 |
| 5,677,028 | 10/1997 | Ravella | 442/118 |

FOREIGN PATENT DOCUMENTS

| | | | |
|---|---|---|---|
| 0211773 | 2/1987 | European Pat. Off. | 15/104.93 |
| 0030993 | 3/1979 | Japan | 15/104.93 |

*Primary Examiner*—Randall E. Chin
*Attorney, Agent, or Firm*—Lee, Mann, Smith, McWilliams, Sweeney & Ohlson

[57] ABSTRACT

A patient bathing system in the form of a sealed, flexible outer package and having at least one impregnated washcloth disposed therewithin. The washcloth is formed of a blended cloth comprising rayon and polyester fibers which have been mechanically entangled, with the quantity by weight of the rayon fibers being much greater than the quantity by weight of the polyester fibers. A cleansing solution impregnates the blended cloth with the cleansing solution being generally uniformly distributed throughout the cloth and being generally non-migratory. The amount of the cleansing solution is far less than the absorbency of the washcloths.

15 Claims, 2 Drawing Sheets

PATIENT BATHING SYSTEM AND WASHCLOTH FOR BODY CLEANSING

RELATED APPLICATION

This application is a division of U.S. patent application Ser. No. 08/961,470, filed Oct. 31, 1997, now U.S. Patent No. 5,956,794.

BACKGROUND OF THE INVENTION

This invention relates to personal care products, and in particular to a patient bathing system having at least one washcloth for body cleansing, the washcloth being disposable and having a generally uniform distribution of cleansing solution.

Co-pending U.S. application Ser. No. 08/684,127, filed Jul. 19, 1996, now U.S. Pat. No. 5,725,311, the disclosure of which is incorporated herein by reference, and Ser. No. 08/944,227, filed Oct. 6, 1997, entitled "Patient Bathing System", now U.S. Pat. No. 5,906,278, the disclosure of which is also incorporated herein by reference, disclose a patient bathing system comprising a series of impregnated washcloths disposed within a hollow outer package. The earlier application is directed to a label seal for the package, while the later application is directed to a particular form of the flexible package for retaining the washcloths.

For patient comfort, it is important that the washcloths be made from blends of fibers which are not irritating, but are sufficiently dense to retain the cleansing solution. The amount of cleansing solution is also very important. Too much cleansing solution will cool the patient's body, and will take too long to dry after the cleansing process. On the other hand, too little cleansing solution will tend to form suds when the washcloths are used, the solution dries too quickly, cleansing will be incomplete, and the patient's skin can be irritated by scrubbing with a too-dry washcloth.

Therefore, not only is it important that the cleansing solution be properly dispersed throughout the washcloths, but also the material of the washcloths is important, as well as the amount of cleansing solution impregnating the washcloths.

SUMMARY OF THE INVENTION

The invention pertains to a washcloth for body cleansing, and a patient bathing system employing at least one of the washcloths. The washcloth comprises a blended cloth comprising first fibers and second fibers, with the fibers being blended by mechanical entanglement, and with the quantity by weight of the first fibers being greater than the quantity by weight of the second fibers. The blended cloth has an absorbency much greater by weight than the weight of the blended cloth. A cleansing solution impregnates the blended cloth, the cleansing solution being generally uniformly distributed throughout the blended cloth and being generally non-migratory in the cloth unless disturbed, such as by compression or otherwise.

In accordance with the preferred form of the invention, the first fibers comprise rayon and the second fibers comprise polyester. The fibers are generally round in cross-section, and have a preferred tensile strength of from about 14 pounds per inch to at least 24 pounds per inch. The rayon fibers are about 1.5 denier and about 1.5 inches in length, while the polyester fibers are about 4.75 denier and about 3 inches in length. The quantity of the rayon fibers comprises about 70% by weight, while the quantity of the polyester fibers comprises about 30% by weight. The fibers are in a concentration of from about 4.3 ounces per square yard to about 5.3 ounces per square yard for an average thickness of the blended cloth being 0.090 inches. Preferably, the concentration is about 4.8 ounces per square yard. The blended cloth has a thickness ranging from about 0.075 inches to about 0.105 inches in depth. Preferably, the thickness is about 0.090 inches.

With the blend according to the invention, absorbency is generally greater than 1,000% by weight of water. The cleansing solution is in the range of from about 22.75 milliliters to about 28.75 milliliters for an 8 inch by 8 inch washcloth which is 0.090 inches in average thickness.

The cleansing solution is preferably composed of water, cleansing agents and moisturizing agents. Preferably, the cleansing agents comprise surfactants and the moisturizing agents comprise humectants. The primary constituent of the solution is water to permit use of the washcloths without a separate rinse or rinse agent.

BRIEF DESCRIPTION OF THE DRAWINGS

The invention is described in greater detail in the following description of an example embodying the best mode of the invention, taken in conjunction with the drawing figures, in which.

DESCRIPTION OF EXAMPLES EMBODYING THE BEST MODE OF THE INVENTION

Figure 1:
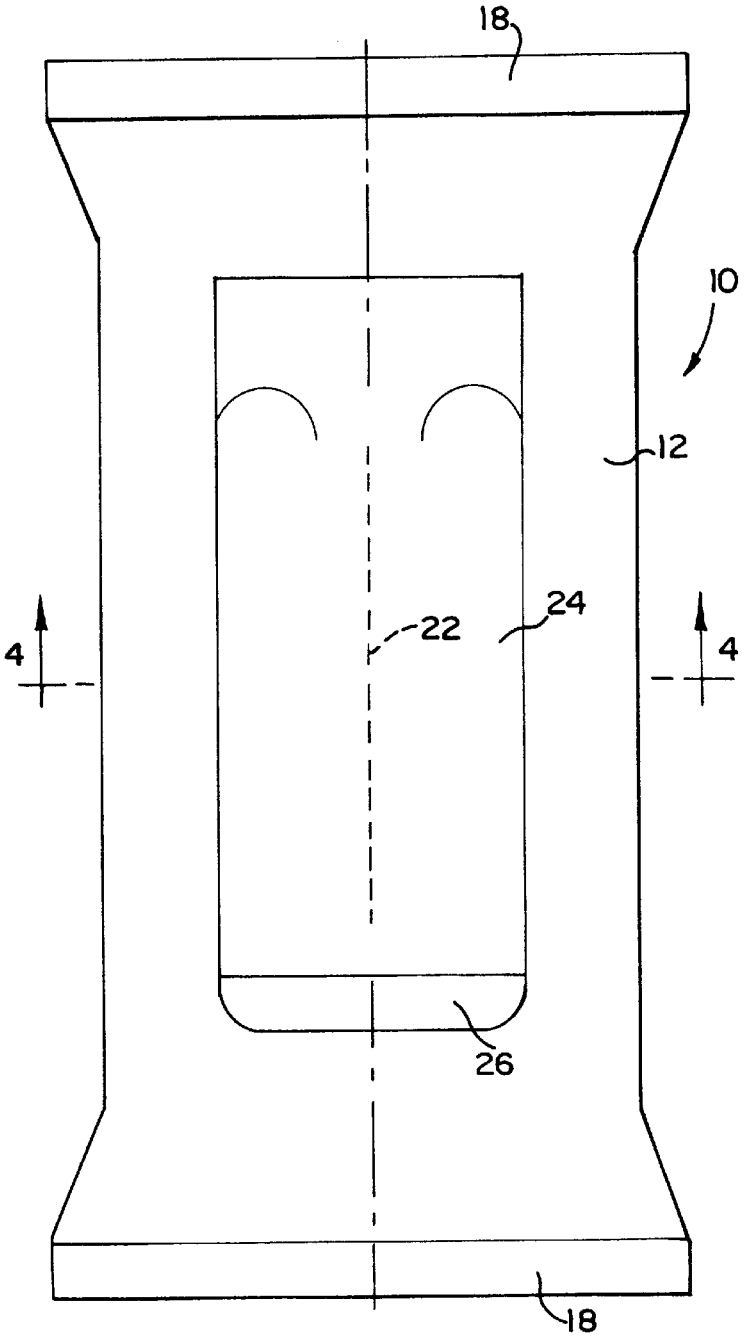
FIG. 1 is a top plan view of a patient bathing system according to the invention.
Figure 2:
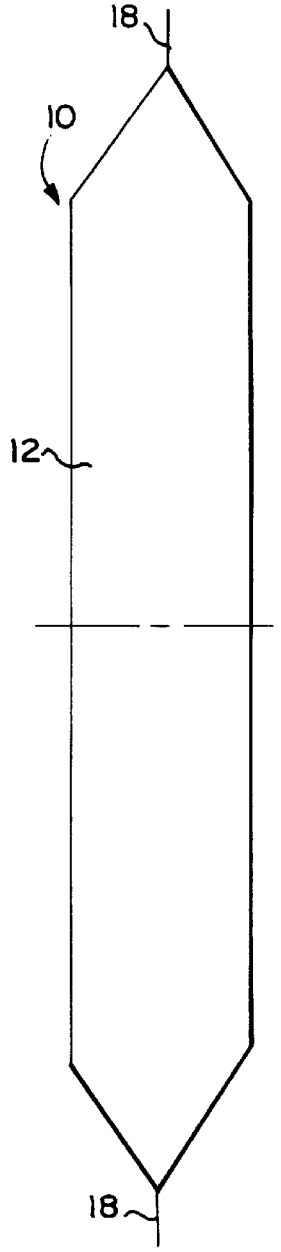
FIG. 2 is a side elevational view thereof.
Figure 3:
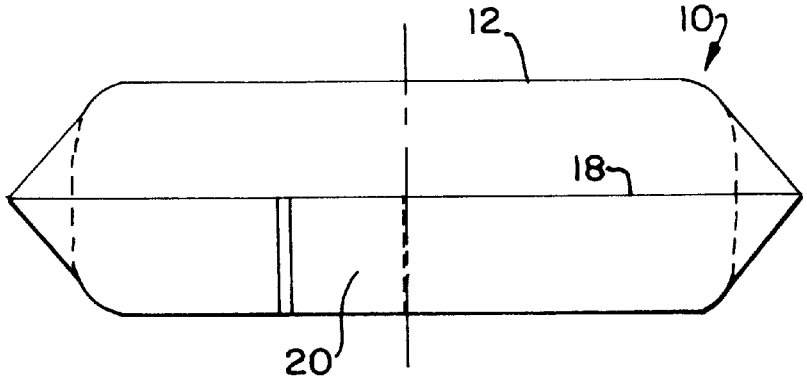
FIG. 3 is an end elevational view thereof.

A patient bathing system having washcloths according to the invention is shown generally at 10 in the drawing figures. The system 10 includes three components, a sealed, hollow, flexible outer package 12, an insulating and supporting layer 14, and a plurality of washcloths 16.

Figure 4:
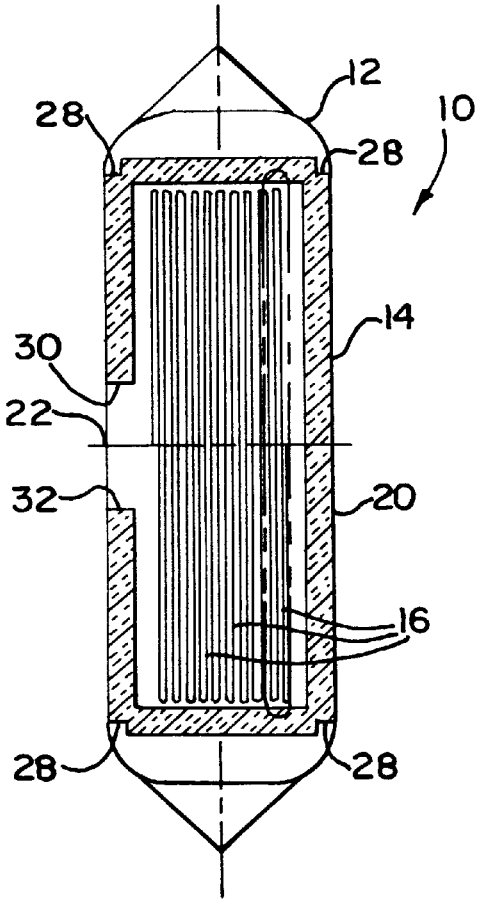
FIG. 4 is a cross-sectional view thereof, taken along lines 4—4 of FIG. 1.
Figure 5:
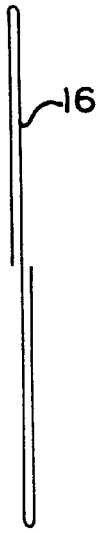
FIG. 5 is an elevational view of one of the washcloths according to the invention, shown surrounded by phantom lines in FIG. 4.

As explained in incorporated application Ser. No. 08/944,227, filed Oct. 6, 1997, the outer package 12 is preferably formed from thin, plastic film in an elongated fashion having a generally rectangular cross-section, as shown in FIG. 4. The package 12 has end heat seals 18 and a longitudinal heat seal 20. The package 12 may be conventional.

The outer package 12 also includes an elongated dispensing slit 22. A seal in the form of a label 24 is applied to the outer package over the slit 22. The label 24 can be conventional or as described in incorporated application Ser. No. 08/684,127. The label 24 also includes a free end 26 which is free to be grasped by a user for peeling the label 24 to expose the slit 22.

The insulating and supporting layer 14 is depicted in FIG. 4. It preferably comprises a foam sheet which has been shaped to conform to the interior of the outer package 12. For shaping purposes, a series of lateral slits 28 are formed in the foam sheet in general registration with the corners of the outer package 12, as explained in incorporated application Ser. No. 08/944,227, filed Oct. 6, 1997.

The insulating layer 14 terminates at opposite end edges 30 and 32. The end edges 30 and 32 are disposed on opposite sides of the elongated dispensing slit 22 to permit access to the interior of the package 12.

The washcloths 16 are individual, folded structures which are stacked one atop the other for individual dispensing through the dispensing slit 22. The washcloths 16 are absorbent and are impregnated with a cleansing solution. The washcloths 16 have a sufficient porosity to hold a desired amount of cleansing solution, which is uniformly dispersed as explained below.

Each of the washcloths 16 comprises a blended cloth comprising first fibers of rayon and second fibers of polyester. Preferably, the rayon is lyocell, although other rayons can be used, as well. The rayon and polyester fibers are blended by mechanical entanglement, such as needle punching, with the quantity by weight of the rayon fibers usually being greater than the quantity by weight of the polyester fibers, and preferably the rayon fibers constituting 70% of the blend by weight, while the polyester fibers constitute 30% of the blend by weight. The washcloth is densely blended and has an absorbency of water much greater by weight than the weight of the blended cloth, with the absorbency being at least eight times by weight, and preferably over 10 times by weight.

The fibers are generally round in cross-section, and when mechanically entangled together have a tensile strength of from about 14 pounds per inch to at least 24 pounds per inch. The rayon fibers are preferably about 1.5 denier and about 1.5 inches in length, while the polyester fibers are about 4.75 denier and about 3 inches in length. The fibers, when concentrated by mechanical entanglement, have a density of about 4.3 ounces per square yard to about 5.3 ounces per square yard for a washcloth having an average thickness of 0.090 inches. The preferred concentration for an optimal washcloth of this thickness is about 4.8 ounces per square yard.

The washcloth 16 can have a thickness from about 0.075 inches to about 0.105 inches, with the preferred thickness being about 0.090 inches. Other depths can be employed so long as the absorbency and concentration of the fibers are within the parameters set forth herein.

The cleansing solution is preferably a no rinse solution which provides both cleansing agents for cleaning purposes and moisturizing agents to prevent skin from drying. The cleansing agents can comprise surfactants and moisturizing agents can comprise humectants. Because the solution is intended to be a non-rinse solution, the primary constituent typically will be water. Preservatives may also be included to lengthen product life. Since many different commonly available cleansing solutions can also be employed in the invention, further details are not set forth herein.

The cleansing solution is evenly dispersed throughout each washcloth, and is precisely metered. The amount of the solution is actually far less than the limit of absorbency of the washcloths. The preferred range of the cleansing solution for an 8"×8" washcloth that is about 0.090 in. in average depth is from about 22.75 ml to about 28.75 ml, with 25 ml being most preferred.

Achievements

The present invention provides a unique, no-rinse washcloth which is comfortable for patient care. The blend of rayon and polyester fibers is important so that the washcloth has a comfortable feel to the patient. Also, the amount of the cleansing solution is important, since too much solution cools the body and takes too long to dry, while too little solution tends to raise suds, dries too quickly before cleansing has been completed, therefore does not clean, and consequently reddens the skin by irritation when insufficient solution is present. By providing the washcloths in a sealed, flexible outer package, a series of washcloths is available for various patient cleaning tasks, and the combination can be heated by microwave or other appropriate means so that the washcloths are at a temperature comfortable to the patient.

Because of the fiber blending and density employed in the present invention, the cleansing solution remains generally uniformly dispersed throughout the washcloths. This prevents situations where portions of the washcloths are over saturated with cleansing solution (thus being too wet) and other portions of the washcloths are under saturated (thus being too dry and abrasive). The amount of the cleansing solution is actually far less than the limit of absorbency of the washcloths, assuring that only a desired amount of cleansing solution is available. With even dispersion of the cleansing solution, the user can be confident that precisely metered amounts of the cleansing solution are available when needed, and the washcloths need not be wrung out or otherwise treated to eliminate excess moisture, or remoisturized because insufficient cleansing solution is available.

The fiber blend, being by means of mechanical entanglement such as needle punching, assures that the washcloths are strong, while not sacrificing either necessary absorbency or comfort to the patient. Because the fibers are tightly woven, the nature of the washcloth promotes absorbency and greatly hinders any possibility of liquid migration throughout the washcloths.

Various changes can be made to the invention without departing from the spirit thereof or scope of the following claims.

What is claimed is:

1. A patient bathing system, comprising a. a sealed, flexible outer package, b. means for gaining access to the interior of said outer package, and c. at least one washcloth for body cleansing disposed within said outer package, said washcloth comprising i. a blended cloth comprising first fibers and second fibers, with the quantity by weight of said first fibers being greater than the quantity by weight of said second fibers, and said blended cloth having an absorbency much greater by weight than the weight of said blended cloth, and ii. a cleansing solution impregnating said blended cloth, said cleansing solution being generally uniformly distributed throughout said blended cloth and generally non-migratory unless disturbed such that the cleaning solution is released from said blended cloth, with the quantity of the cleansing solution being far less than the absorbency of said blended cloth.

2. A patient bathing system according to claim 1 including a plurality of said washcloths disposed within said outer package for dispensing through said access means.

3. A patient bathing system according to claim 1 in which said first fibers comprise rayon and said second fibers comprise polyester.

4. A washcloth according to claim 1 in which said fibers are in a concentration of from about 4.3 oz/sq yd to about 5.3 oz/sq yd for an average thickness of said blended cloth of 0.090 in.

5. A washcloth according to claim 4 in which said concentration is about 4.8 oz/sq yd.

6. A washcloth according to claim 1 in which said blended cloth has a thickness of from about 0.075 in to 0.105 in.

7. A washcloth according to claim 6 in which said thickness is about 0.090 in.

8. A washcloth according to claim 1 in which said absorbency is generally greater than 1000% by weight of water.

9. A washcloth according to claim 1 in which said solution is in the range of from about 22.75 ml to about 28.75 ml per 8"×8" washcloth that is about 0.090 in. in average thickness.

10. A washcloth according to claim 1 in which said fibers are blended by mechanical entanglement.

11. A washcloth according to claim 1 in which said first fibers comprise rayon and said second fibers comprise polyester.

12. A washcloth according to claim 11 in which said fibers are generally round in cross section.

13. A washcloth according to claim 11 in which said blended fibers have a tensile strength of from about 14 lb/in to at least 24 lb/in.

14. A washcloth according to claim 11 in which said rayon fibers are about 1.5 denier and about 1.5 in long, and said polyester fibers are about 4.75 denier and about 3 in long.

15. A washcloth according to claim 11 in which the quantity of rayon is about 70% by weight and the quantity of polyester is about 30% by weight.

* * * * *